US005098090A

United States Patent [19]

Juhl

[11] Patent Number: 5,098,090

[45] Date of Patent: Mar. 24, 1992

[54] BASKETBALL RETURN DEVICE

[76] Inventor: Mark Juhl, P.O. Box 185, Bendena, Kans. 66008

[21] Appl. No.: 721,975

[22] Filed: Jun. 27, 1991

[51] Int. Cl.[5] ..... A63B 69/00

[52] U.S. Cl. ..... 273/1.5 A

[58] Field of Search ..... 273/1.5 A, 396, 397

[56] References Cited

U.S. PATENT DOCUMENTS

| | | | |
|---|---|---|---|
| 3,204,957 | 9/1965 | Logue | 273/1.5 A |
| 3,233,896 | 2/1966 | King | 273/1.5 A |
| 3,814,421 | 6/1974 | Spier, Jr. | 273/1.5 A |
| 4,667,957 | 5/1987 | Joseph | 273/1.5 A |
| 4,678,189 | 7/1987 | Koss | 273/1.5 A |
| 4,706,954 | 11/1987 | Kershaw | 273/1.5 A |
| 4,720,101 | 1/1988 | Farkas, Jr. | 273/1.5 A |
| 4,786,052 | 11/1988 | Zinger | 273/1.5 A |
| 4,913,431 | 4/1990 | Jakobs | 273/1.5 A |
| 4,915,380 | 4/1990 | Ackerman | 273/1.5 A |
| 4,936,577 | 6/1990 | Kington | 273/1.5 A |
| 4,957,289 | 9/1990 | Kotlarz | 273/1.5 A |

OTHER PUBLICATIONS

Applicants Exhibits A-F Filed 7/27/91 Publication Dates Unknown.

*Primary Examiner*—Paul E. Shapiro

[57] ABSTRACT

A basketball return device for improving the efficient utilization of individual shooting practice time is provided which effectively returns all successful basketball shots to the shooter at any preselected location on the basketball court. The device includes a circular ring which attaches to any standard basketball net using resilent straps, providing a non-rigid and adjustable mounting system preventing damage to the device, basketball backboard, goal, and basketball from errant shots and extended use. A basketball passing through the basketball net is directed onto a curved track which guides the basketball back to the shooter.

7 Claims, 2 Drawing Sheets

BASKETBALL RETURN DEVICE

BACKGROUND OF THE INVENTION

This invention relates generally to devices intended to return the basketball to the shooter, and more particularly, to a basketball return device attached to the net of a basketball goal and designed to return the basketball to any position on the basketball court.

Practicing a skill repetitively has been proven to be a key factor in developing consistent skill performance in athletics. Repetitive practice is particularly important in the game of basketball. The well known object of the game of basketball is to shoot the ball through a circular rim. An inverted truncated conical net, typically constructed of rope, is suspended beneath the rim. Basketball players typically spend a great deal of time repetitively practicing to improve their shooting performance.

Unfortunately, a shot basketball which passes through the basketball goal typically drops straight beneath that goal. Thus, the practicing shooter must either rely upon an assistant to return the ball to him or her or must leave his or her shooting practice position to walk under the goal to retrieve the ball.

In an effort to permit practicing shooters to repeat shots from the same position, several devices have been introduced in the last ten years. These prior art basketball return devices fall into two general categories: (1) return devices designed to return all basketballs shot in the direction of the goal; and (2) return devices designed to return only basketballs which pass through the basketball goal.

Prior art return devices falling in the first category—devices designed to return all shot basketballs—typically consist of a large netting structure supported from the floor or hung on the backboard. Players must shoot the ball in a substantially arced trajectory to insure that it will pass over the netting structure toward the goal. A portion of the missed shots rebound against the inside of the net enclosure and are funnelled to a floor-supported ball return track. The balls roll back to the shooter along this track. Basketballs which pass through the basketball goal are also funnelled onto the return track. These devices are typically cumbersome, quite costly, and obstruct the shooter's view of the goal.

Return devices falling into the second category—devices designed to return only "made" shots which pass through the basketball goal—typically consist of a short track rigidly mounted to the backboard or rim of the goal. The capabilities of these devices are very limited since they will direct made shots only in a direction perpendicular to the backboard back toward the free throw area. In many cases, the ball is deflected by the rigid return structure and fails to roll properly down the short tract. Moreover, these rigidly mounted devices are subject to damage if directly struck by a basketball.

While these prior art devices adequately return basketballs in some situations, a need remains for a basketball return device which: (i) consistently returns all made shots to the shooter; (ii) does not impair the shooter's view of the goal; (iii) can be adjusted to return the basketball to any position on the court; and (iv) which will survive direct impact by a basketball missing the goal without damage.

SUMMARY OF THE INVENTION

Thus, it is an object of this invention to provide an improved basketball return device which will consistently return all made shots to the shooter at any location on the basketball court. It is a further object of this invention to provide an improved basketball return device which does not impair the shooter's view of the goal. It is a still further object of this invention to provide a durable basketball return device which will survive direct impacts by a basketball.

The invention includes a circular mounting ring which is designed to be attached to the net suspended beneath the basketball goal The mounting ring is attached to the net using resilient attaching means which enable the device to survive direct and repeated impact without damage. Attached to one the end of the mounting ring and passing beneath the mounting ring and in the direction of a shooter is a track along which the basketball rolls in the direction of the shooter. The device is designed, either by structure or using a separate counter balance, so that the center of gravity of the device attached to the net is located approximately beneath the center of the circle formed by the basketball rim. Finally, the mounting ring includes a means for controlling the movement of the basketball through the ring by reducing the velocity of the basketball passing through the mounting ring and by guiding the basketball to the track to ensure consistent return of the basketball to the desired location.

DETAILED DESCRIPTION

Figure 1:
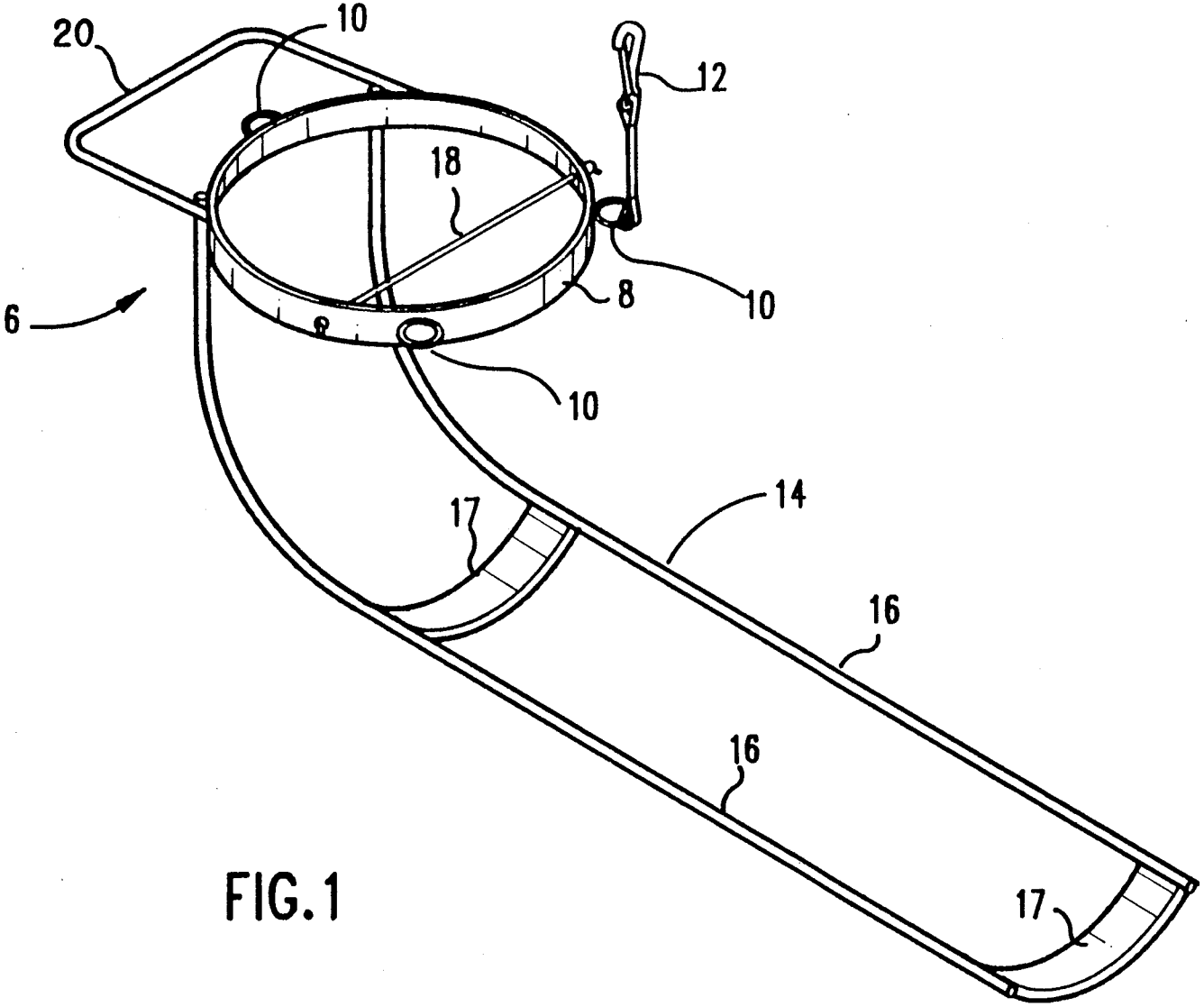
FIG. 1 is a perspective view of a preferred embodiment of the basketball return device.
Figure 2:
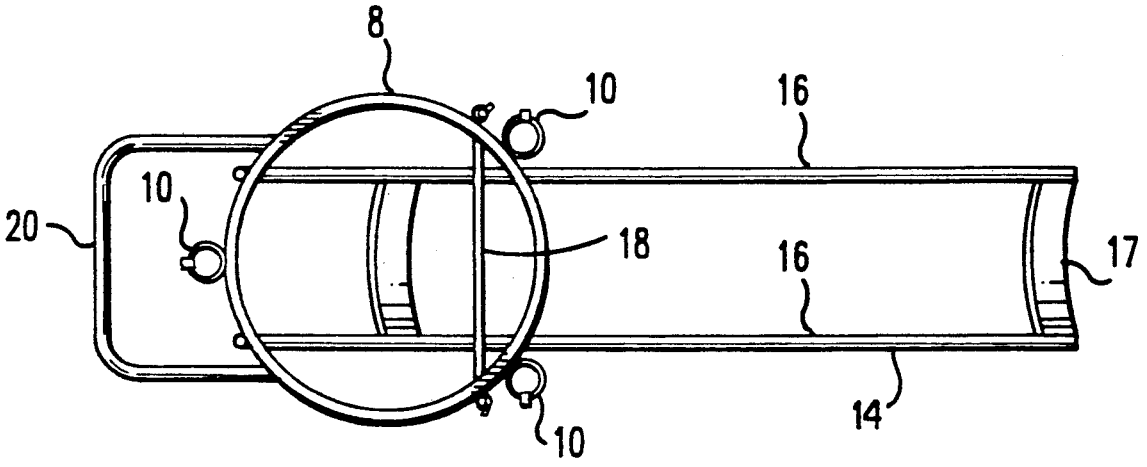
FIG. 2 is a top view of a preferred embodiment of the basketball return device.
Figure 3:
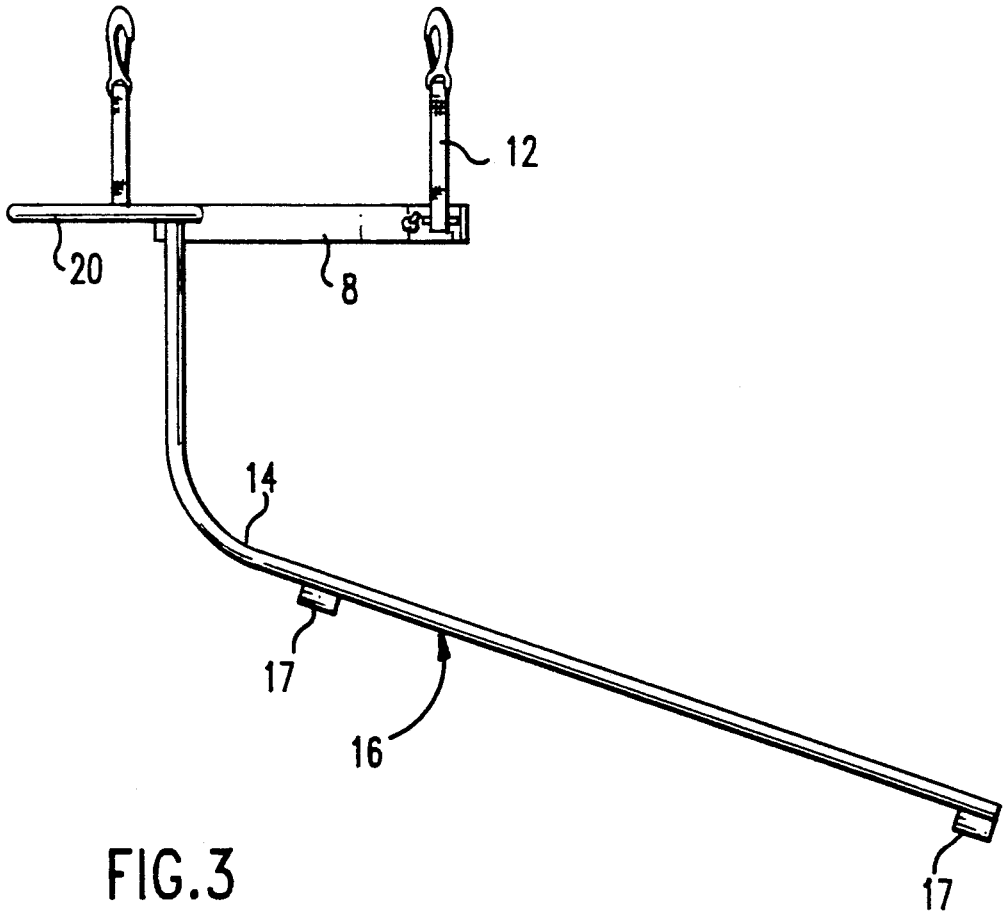
FIG. 3 is a side view of a preferred embodiment of the basketball return device.

Referring now to the drawings, a preferred embodiment of the basketball shooting device (6) is shown. The basketball return device includes a circular mounting ring (8) formed in the shape of a hollow cylinder having an internal diameter slightly larger than the external diameter of a basketball. The mounting ring (8) is attached to the basketball net using resilient attaching means which enable the device to survive direct and repeated impact without damage. In the preferred embodiment shown in FIGS. 1, 2 and 3, the means for attaching the mounting ring (8) to the net comprises three attachment brackets (10) equally spaced along the circumference of the mounting ring (8) with resilient attaching straps (12) each passing around a portion of the basketball net and attached at both ends to the corresponding attaching bracket (8). In a preferred embodiment of the device the attaching straps are made of an elastic rubber material.

A curved track (14) is attached to the mounting ring (8) to direct the basketball toward the shooter. In the preferred embodiment shown in FIGS. 1, 2 and 3, the track (14) comprises two parallel rigid metal tubes (16), with appropriate support structure (17), attached to the circumference of the mounting ring (8). The track (14) extends vertically beneath the mounting ring (8) with a curved configuration which passes directly beneath the mounting ring (8) and continues beyond the plane of the circumference of the mounting ring.

Located within the interior of the mounting ring (8) is a resilient ball control means intended to reduce the velocity of the basketball passing through the mounting ring and to direct the basketball against the track (14). In the preferred embodiment shown in FIGS. 1, 2 and 3, the ball control means comprises an elastic cord (18) having a length less than the internal radius of the mounting ring (8) and extending between two points in the interior of the mounting ring opposite the point of attachment of the track (14). Thus, a portion of the internal circumference of the mounting ring and the elastic ball control means defines an enclosure somewhat smaller than the diameter of a basketball. A number of other different control means may be used to reduce the velocity of the basketball and to force in the direction of the track.

It is important that the basketball return device be designed and constructed so that the center of gravity of the device is located approximately beneath the center of the basketball goal rim. In the preferred embodiment shown in FIGS. 1, 2 and 3, a counterbalance (20) is attached to the mounting ring (8) at approximately the point of attachment of the track (14) and passes away from the mounting ring (8) in a direction opposite the track (14) so that the center of gravity is located in the appropriate position.

In operation, the preferred embodiment of the basketball return device is attached near the base of the basketball net by passing the attaching straps (12) through the webs of the net and affixing both ends of the straps to the corresponding attaching bracket (10). For best results, a single strap is attached to the portion of the net furthest from the shooter in a position slightly lower on the net than the two attaching straps located near the front of the net.

A shot basketball passes through the basketball goal rim and into the basketball net. As the ball continues through the net, its contact with the net typically reduces lateral movement of the basketball and directs it downward. The basketball continues through the net and passes into the interior of the mounting ring (8). As the basketball passes through the mounting ring (8), it contacts the ball control cord (18) which defines an enclosure slightly smaller than the diameter of the basketball. As the basketball forces the resilient ball control cord to move to slightly enlarge the defined enclosure, the velocity of the basketball is reduced. The resilient nature of the basketball control cord exerts force on the basketball directing it towards the back of the mounting ring (8) and firmly onto the track (14).

As the ball passes beyond the mounting ring (8), it rolls along the track (14) in the direction of the shooter. As it passes the direction of the shooter, it moves beyond the center of gravity of the basketball return device, causing the return device to tip slightly so that the end of the track (14) nearest the shooter moves towards the floor of the basketball court.

The position of the basketball return device may be changed by simply rotating the position in which it is attached to the net so that the track (14) points in the desired direction. This adjustability represents a significant improvement over prior art devices which are designed to only return the ball in a direction perpendicular to the basketball goal backboard. Moreover, if a shot basketball completely misses the goal and directly impacts any portion of the basketball return device, the resilient nature of the attaching straps, combined with the natural resiliency of the rope net, absorbs the impact of the ball and reduces the likelihood of damage to basketball return device.

I claim:

1. A basketball return device comprising:

a circular mounting ring having an internal diameter larger than the external diameter of a basketball;

means for attaching said mounting ring to the net of a basketball goal;

a curved track attached to said mounting ring and extending beneath said mounting ring; and means for controlling the velocity and direction of a basketball passing through said mounting ring.

2. The basketball return device of claim 1 further comprising a plurality of attaching brackets rigidly fixed to the circumference of said mounting ring; and wherein said means for attaching said mounting ring comprises a plurality of resilient straps attached to said brackets.

3. The basketball return device of claim 1 wherein said means for controlling the velocity and direction of a basketball passing through said mounting ring comprises an elastic cord connected between two points on the interior of said mounting ring.

4. The basketball return device of claim 3 further comprising a plurality of attaching brackets rigidly fixed to the circumference of said mounting ring; and wherein said means for attaching said mounting ring comprises a plurality of resilient straps attached to said brackets.

5. The basketball return device of claim 1 further comprising a counterbalance attached to the mounting ring and extending is a direction opposite the direction of said curved track.

6. The basketball return device of claim 5 wherein said means for controlling the velocity and direction of a basketball passing through said mounting ring comprises an elastic cord connected between two points on the interior of said mounting ring.

7. The basketball return device of claim 6 further comprising a plurality of attaching brackets rigidly fixed to the circumference of said mounting ring; and wherein said means for attaching said mounting ring comprises a plurality of resilient straps attached to said brackets.

* * * * *